United States Patent [19]

Clark et al.

[11] Patent Number: 4,898,251

[45] Date of Patent: Feb. 6, 1990

[54] EARTH BORING APPARATUS

[75] Inventors: Maxwell J. Clark, R.M.B. 7610, Reith Rd., Wangaratta, Victoria; Roy McMillan; Frank J. Ogden, both of Wangaratta, all of Australia

[73] Assignee: Maxwell John Clark, Victoria, Australia

[21] Appl. No.: 240,234

[22] PCT Filed: Oct. 23, 1987

[86] PCT No.: PCT/AU87/00360

§ 371 Date: Aug. 23, 1988

§ 102(e) Date: Aug. 23, 1988

[87] PCT Pub. No.: WO88/03221

PCT Pub. Date: May 5, 1988

[30] Foreign Application Priority Data

Oct. 23, 1986 [AU] Australia ..... 64335/86

[51] Int. Cl.[4] ..... E21B 44/00; E21B 3/02

[52] U.S. Cl. ..... 175/27; 175/62; 175/113; 175/122; 175/220; 173/4; 173/145; 173/164

[58] Field of Search ..... 175/62, 26, 27, 113, 175/121, 122, 162, 195, 220; 166/77.5; 173/4, 145, 156, 164; 81/57.16, 57.34, 57.35; 408/146, 186, 197, 198, 13

[56] References Cited

U.S. PATENT DOCUMENTS

| | | | |
|---|---|---|---|
| 1,932,068 | 10/1933 | Englebright et al. | 175/62 |
| 2,797,066 | 6/1957 | Sewell | 175/122 |
| 2,835,472 | 5/1958 | Osborn | 175/62 |
| 2,985,249 | 5/1961 | Beaumont | 173/4 |
| 3,155,171 | 11/1964 | Kurt et al. | 175/27 |
| 3,239,016 | 3/1966 | Alexander | 166/77.5 |
| 3,302,735 | 2/1967 | Klem et al. | 175/122 |
| 3,605,910 | 9/1971 | Deeter et al. | 173/4 |
| 4,441,564 | 4/1984 | Castillo | 175/62 X |

FOREIGN PATENT DOCUMENTS

| | | |
|---|---|---|
| 2198948 | 10/1948 | Australia . |
| 956355 | 12/1956 | Australia . |
| 3649671 | 6/1973 | Australia . |
| 5839573 | 1/1975 | Australia . |
| 942741 | 4/1956 | Fed. Rep. of Germany . |

*Primary Examiner*—Bruce M. Kisliuk

*Attorney, Agent, or Firm*—Cushman, Darby & Cushman

[57] ABSTRACT

An earth boring apparatus for driving a boring tool, the tool having a head for penetrating the earth and a longitudinally extending rotary drive shaft (15) for advancing the head. A carriage (18) is mounted to support frame (10) for advancing movement so as to advance and retract the drive shaft (15) and head. A drive shaft extension can be fitted between the carriage (18) and the drive shaft (15) thereby extending the effective length of the drive shaft (15). The apparatus includes a shaft engaging member (40) associated with the frame (10) and selectively operative to engage the shaft (15) having the head thereon and to inhibit rotation thereof thereby enabling the carriage (18) to be retracted and the drive shaft extension to be fitted between the carriage (18) and the shaft (15). The drive means (25) includes reaction means (30) capable of reacting to variations in earth resistance to penetration by the head, and control means (35) is responsive to the reaction means (30) to disable or control the operation of the advancing drive means (25) to lessen the advancing force in response to a significant increase in earth resistance. The frame (10) includes a base portion (11,14) for engaging the ground and a carriage track (20) located above the base portion (11,14) so as not to engage the ground, the carriage (18) being located laterally of the track (20) and being drivingly engaged with the track (20) from its lateral position whereby reducing debris causes interference with the drive engagement between carriage (18) and the track (20).

14 Claims, 3 Drawing Sheets

EARTH BORING APPARATUS

This invention relates to apparatus for driving boring tools and particularly to apparatus for boring underground.

Public utilities frequently need to bore underground, e.g. under roads for insertion of new conduits. The presently available machine for this purpose includes a frame which rests at the bottom of a hole. The frame has two tracks with chains along their top surface. A carriage is driven manually along the tracks by turning a wheel which in turn is coupled to sprockets meshed with the chains. Debris falling on the tracks interferes with the advancement of the carriage. Also the machine needs to be continuously attended to control the boring operation.

This known machine has a hydraulic motor which drives a rotating drive shaft having a head which bores into the ground. When the shaft is to be lengthened, considerable manual force needs to be applied by means of Stilsons to disconnect the threaded connection between the drive motor and the drive shaft to enable the carriage to be retracted and a drive shaft extension inserted.

If the head engages harder ground, the operator of the drive wheel must detect this increased resistance by sound or feel and lessen the force being applied to allow the head to bore through the obstruction.

It is an object of a first aspect of the present invention to provide a penetrating apparatus which requires less physical effort to utilise and which is capable of use by one person.

It is an object of a second aspect to provide a penetrating apparatus which is capable of automatic compensating response to differing resistances to penetration.

It is an object of a third aspect of the present invention to provide penetrating apparatus which is not as susceptible to debris causing interference with the drive as in the prior apparatus.

According to the first aspect of the present invention there is provided an earth boring apparatus for driving a boring tool, the tool having a head for penetrating the earth and a longitudinally extending rotary drive shaft for advancing the head, the apparatus including a support frame, a carriage mounted to the support frame for advancing movement so as to advance the drive shaft and head to penetrate the earth, the carriage furthermore being mounted for retracting movement relative to the frame so as to enable a drive shaft extension to be fitted between the carriage and the drive shaft that has the head thereon thereby extending the effective length of the drive shaft, the apparatus being characterised in that the earth boring apparatus includes a shaft engaging member associated with the frame and selectively operative to engage the shaft having the head thereon and to inhibit rotation thereof thereby enabling the carriage to be retracted and the drive shaft extension to be fitted between the carriage and the shaft.

Preferably the shaft engaging member is operative to frictionally engage with the shaft to inhibit rotation thereof. The shaft engaging member is preferably operative to engage with the shaft to inhibit rotation thereof but to allow relative longitudinal movement of the shaft.

In the preferred embodiment the shaft engaging member is operative to engage the shaft to inhibit rotation of the shaft in a first rotational direction but to allow rotation thereof in the reverse rotational direction. Shaft drive means is preferably provided for rotating the shaft and the head in the reverse rotational direction to effect boring of the earth, the shaft drive means including a reversible drive source and a threaded portion for engaging with a complementary threaded end portion of the shaft, the shaft engaging member being operative when the drive source is reversed to rotate in the first direction to restrain the shaft against rotation in the first rotational direction thereby effecting disengagement of the threaded portion of the drive means from the threaded end of the shaft. The shaft drive means preferably further includes a thrust bearing between the drive source and the threaded portion of the drive shaft whereby upon reversal of the direction of rotation of the drive source to cause it to rotate in the first direction and restraint of the shaft against rotation, the threaded portion of the drive means readily disengages from the threaded end portion of the shaft.

The shaft engaging member may include a roller for contacting the shaft, the axis of rotation of the roller being generally transverse to the longitudinal direction of the shaft, the roller when engaged with the shaft inhibiting rotational movement of the shaft but allowing longitudinal movement thereof. The roller in use may engage with the drive shaft to locate and guide the same while allowing longitudinal advancing and retracting movement of the shaft and allowing rotation of the shaft in one direction, the roller being mounted by mounting means operative to enable the roller to move in a direction to tightly engage or jam against the shaft upon commencement of rotating movement of the shaft in one direction so as to thereby grip the shaft. In this embodiment the mounting means may mount the roller for movement relative to a portion of the support frame, the mounting means including a camming arrangement which causes the roller to tightly engage with the shaft upon rotational movement of the shaft in the one direction. The roller may be mounted to a carrier which in turn is mounted by an axle therethrough to a track which inclines towards the shaft axis, rotation of the drive shaft in the one direction tending to move the roller in the direction such that the axle moves in the track towards the drive shaft axis thereby causing the roller to tightly engage with the drive shaft and grip the same.

According to the second aspect of the invention there is provided an earth boring apparatus for driving a boring tool, the tool having a head for penetrating the earth and a longitudinally extending rotary drive shaft for advancing the head, the apparatus including a support frame, a carriage mounted to the support frame for advancing movement so as to advance the drive shaft and head to penetrate the earth, the carriage furthermore being mounted for retracting movement relative to the frame so as to enable a drive shaft extension to be fitted between the carriage and the drive shaft that has the head thereon thereby extending the effective length of the drive shaft, the apparatus further including advancing drive means for advancing the carriage and thus the drive shaft and head, characterised in that the drive means includes reaction means capable of reacting to variations in earth resistance to penetration by the head, the apparatus further including control means responsive to the reaction means to disable or control the operation of the advancing drive means to lessen the advancing force in response to a significant increase in earth resistance.

In this second aspect the reaction means may comprise a reaction member mounted for least limited movement relative to its mounting, the reaction member being arranged such that a substantial impediment to movement of the carriage causes in reaction a movement of the reaction member relative to its mounting, the control means being responsive to the reaction movement of the reaction member to at least temporarily disable the advancing drive means acting to advance the carriage. Preferably the apparatus includes biasing means arranged to be operative upon occurrence of the reaction movement of the reaction member and being arranged such that the biasing means applies a force tending to advance the carriage after the drive acting to advance the carriage has been disabled in response to operation of the control means. The force applied by the biasing means may be selectively adjustable to enable selective adjustment of the biasing means applied advancing force.

In one possible arrangement, the advancing drive means is mounted on the carriage and includes a rotary drive bar for transmitting drive so as to advance the carriage, the reaction member including a mounting for the drive means and which is capable of limited pivoting movement relative to the carriage about an axis collinear with the rotational axis of the rotary drive bar, the limited pivoting movement of the mounting occurring in response to impeded movement of the carriage and continued operation of the drive means including rotary movement of the drive bar, the disabling means including a disabling switch operable in response to the limited pivoting movement to disable the drive means.

In an alternative embodiment the advancing drive means comprises a hydraulic ram and associated hydraulic supply line, the reaction means including a hydraulic fluid pressure sensor for sensing fluid pressure increases resulting from ground resistance increases, the control means including a control valve responsive to the fluid pressure sensor and operative to control hydraulic fluid pressure supplied to the ram to thereby control advancing movement of the drive shaft.

According to the third aspect of the present invention there is provided an earth boring apparatus for driving a boring tool, the tool having a head for penetrating the earth and a longitudinally extending rotary drive shaft for advancing the head, said apparatus including a support frame, a carriage mounted to the support frame for advancing movement so as to advance the drive shaft and head to penetrate the earth, the carriage furthermore being mounted for retracting movement relative to the frame so as to enable a drive shaft extension to be fitted between the carriage and the drive shaft that has the head thereon thereby extending the effective length of the drive shaft, characterised in that the frame includes a base portion for engaging the ground and a carriage track located above the base portion so as not to engage the ground, the carriage being located laterally of the track and being drivingly engaged with the track from its lateral position whereby reducing debris caused interference with the drive engagement between carriage and the track.

In this third aspect the carriage may include a track follower arranged to follow the track with a rolling engagement, the track follower closely engaging with the track to limit rocking movement of the carriage relative to the track. Preferably the track follower includes upper rollers closely engaging with an upper surface of the track and lower rollers closely engaging with a lower surface of the track, the upper and lower rollers restraining the carriage against any movement of the carriage relative to the track except linear movement in the longitudinal direction of the track.

A drive means may be provided on the carriage for advancing and retracting the carriage, the drive means including a drive wheel mounted for rotating movement about an upright axis and being laterally adjacent the track and operative to drive the carriage along the track as the drive wheel is rotated. The drive means may include a drive chain which extends along the track, the drive wheel comprising a drive sprocket meshing with the drive chain. The drive chain may be fixed to the frame at each end, the chain extending from a first end along the track, around an idler wheel on the carriage, thence around the drive sprocket, thence around a further idler wheel and along the track to the opposite end.

Possible and preferred features of the present invention will now be described with particular reference to the accompanying drawings. However it is to be understood that the features illustrated in and described with reference to the drawings are not to be construed as limiting on the scope of the invention. In the drawings.

Figure 1:
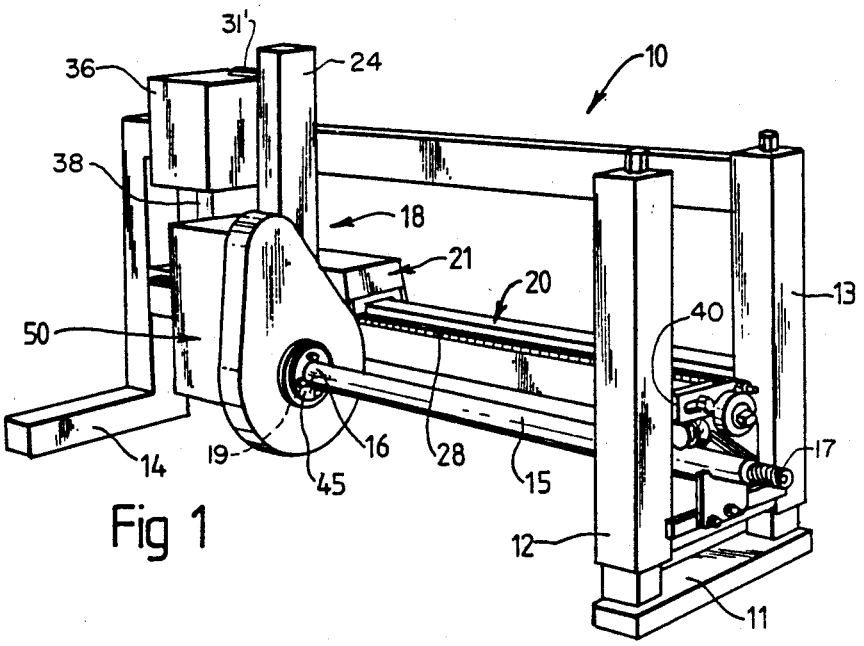
FIG. 1 is a general perspective view of a boring apparatus.

Referring firstly to FIG. 1, the boring apparatus includes a support frame 10 for resting in the bottom of a hole. The front base plate 11 engages the ground and threaded shafts within the front frame posts 12, 13 enable adjustment of the frame elevation.

The apparatus has an elongated drive shaft 15 having a threaded outer end 17 which in use mounts a cutting or boring head (not shown). Water can be passed through both the shaft 15 and the head to wash soil dislodged by the head from the hole bored. In use the shaft 15 is advanced longitudinally and rotated to effect boring through the ground in a normal direction opposite to the direction shown by arrow "D".

A carriage 18 is mounted to the support frame 10 for advancing movement so as to advance the shaft 15, the carriage 18 also being retractable to enable the shaft 15 to be left in the bored hole while a shaft extension is fitted between the carriage 18 and the shaft 15 to thereby extend the effective length. This process is continued until the bore reaches the required distance.

The frame 10 includes a base portion comprising the front base plate 11 and the rear base portion 14 both engaging the ground. A carriage track 20 is located above the base portion so as not to engage the ground. The carriage 18 is located laterally of the track 20 and is drivingly engaged with the track 18 from its lateral position so that debris is less likely to interfere with the drive engagement.

Figure 2:
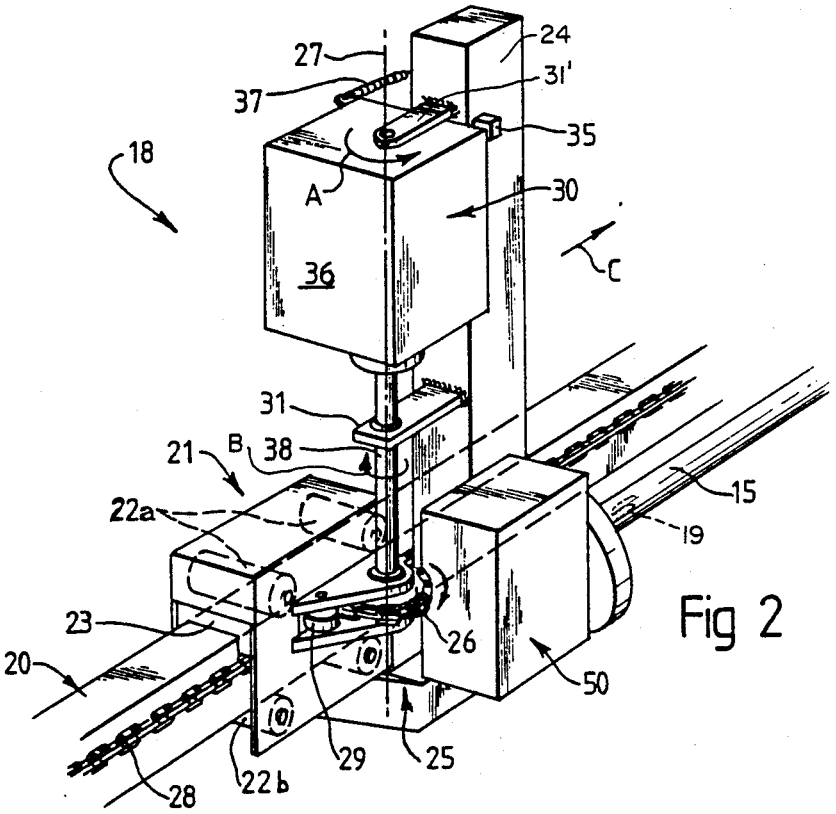
FIG. 2 is a perspective view of a carriage drive arrangement.

As seen in FIG. 2 the carriage 18 includes a vertical post 24, track follower 21 drive means 25, a housing 36 and drive motor 50. Track follower 21 is arranged to follow the track 20 with a rolling engagement by upper and lower rollers *22a*, *22b* the track follower 21 closely engaging with the track 20 to limit rocking movement of the carriage 18 relative to the track 20. The track follower 21 includes scraping means in the form of blades 23 to scrape debris from the track 20 as the carriage 18 moves.

Drive means 25 on the carriage 18 advances and retracts the carriage 18. The drive means 25 includes a drive wheel in the form of sprocket 26 mounted for rotating movement about axis 27. A drive chain 28 extends along the track 20. The chain 28 is fixed at each end and passes around idler wheels 29 on either side of the sprocket 26 to provide good driving engagement between the sprocket 26 and the chain 28.

This arrangement of frame and drive track and drive connection between the carriage and frame is much less susceptible to debris interfering with the advancing and retracting movement.

The advancing drive means 25 includes a reaction means shown as a reaction member generally designated 30 which includes a housing 36, with an internal motor (not shown) pivotally supported on post 24 by mounting brackets 31 and 31', and a biasing spring 37 so that housing 36 is capable of at least limited movement relative to such mountings and post #15. The arrangement is such that a substantial impediment to advancing movement of the carriage 18 causes in reaction a movement of the reaction member 30 relative to its mounting 31, i.e. a reaction movement in the direction of arrow "A". Disabling means in the form of a disabling switch 35 mounted on post 24 so as to be engageable by housing 36 when it moves in the direction of arrow "A". Switch 35 is responsive to the reaction movement of the reaction member 30 to disable the carriage advancing drive (such as a motor within housing 36).

Biasing means, shown as spring 37 between the housing 36 and the carriage 18, is arranged to be extended upon occurrence of the reaction movement of the reaction member 30 in the direction of arrow "A" and is arranged to apply a force tending to move the housing 36 and hence the drive bar 38 and sprocket 26 in the direction of arrow "B", thus tending to advance the carriage 18 in the direction of arrow "C" after operation of the drive disabling switch 35.

The force applied by the biasing spring 37 may be adjustable to enable selective adjustment of the biasing spring applied advancing force. For example, the tension on the spring 37 may be varied by moving one of its anchored ends selectively.

In the particular arrangement of FIG. 2, the advancing drive means 25 is mounted on the carriage 18 and includes rotary drive bar 38 for transmitting drive so as to advance the carriage 18. The reaction member 30 comprises a mounting for the drive means 25 which is capable of limited pivoting movement relative to the carriage 18 about axis 27, i.e. about the rotational axis of the rotary drive bar 38, the limited pivoting movement of the mounting occurring in response to impeded movement of the carriage 18 and to continued operation of the drive means 25 including rotary movement of the drive bar 38.

This particular advancing drive arrangement enables the carriage 18 to stop automatically if the boring head encounters an obstruction and to advance as slowly as the boring head makes progress through the obstruction, this slow movement being under the force of the biasing spring 37. If the carriage 18 reaches the end of the frame 10, the switch 35 will similarly be operated to disable the carriage drive means 25 automatically.

Figure 3:
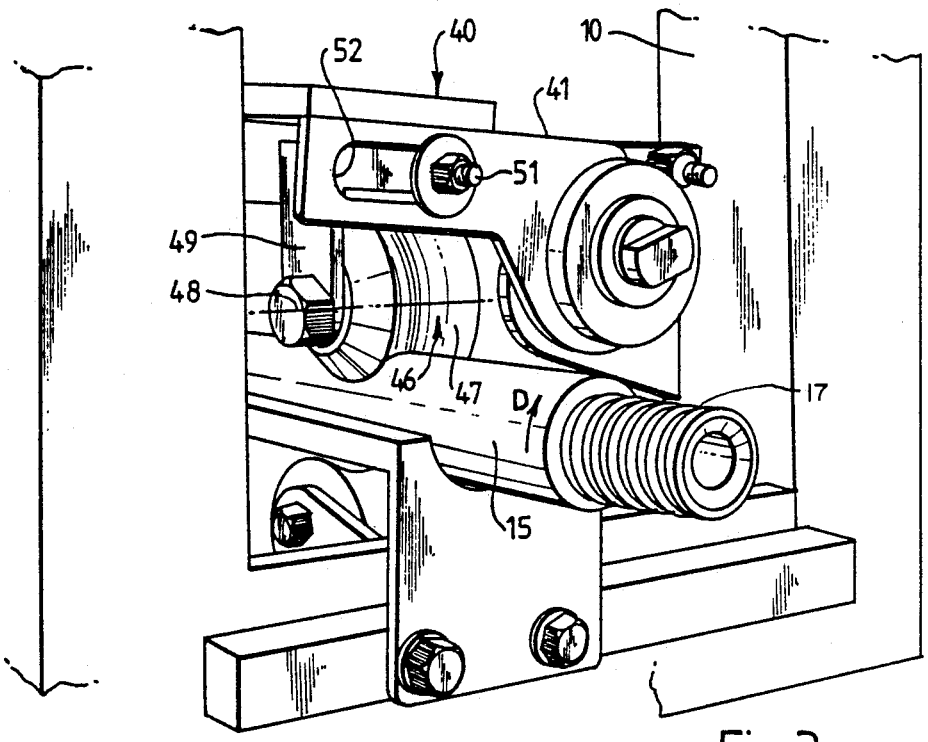
FIGS. 3 and 4 are detailed and exploded view respectively of a drive shaft engaging arrangement.
Figure 4:
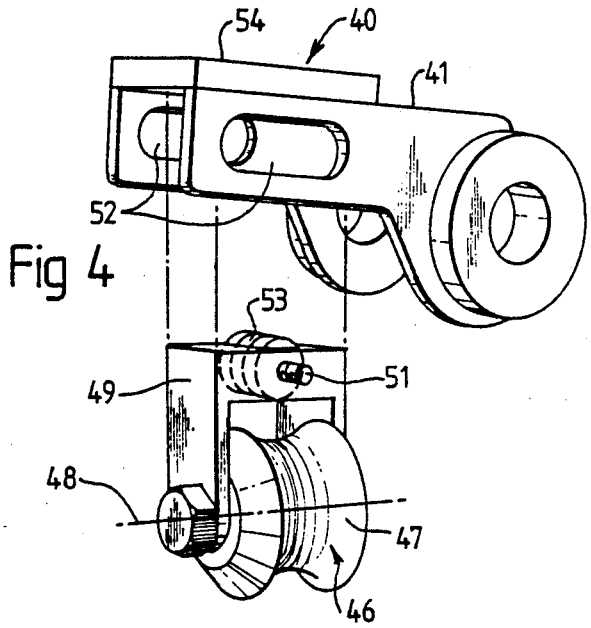

Referring to FIGS. 3 and 4, a shaft engaging or gripping member 40 is mounted to the frame 10 on pivoted support 41 which is held down into contact with the shaft 15 in use, but which can be lifted for initial shaft placement or for maintenance purpose. The member 40 can grip the shaft 15 to enable the carriage 18 to be retracted and a drive shaft extension to be fitted to the gripped shaft 15.

A reversible drive motor 50 (FIG. 1) drives a threaded stub 19, as shown in FIG. 2 which engages in a complementary threaded bore in the end 16 of the shaft 15. A thrust bearing 45 is provided between the drive motor 50 and the threaded stub 19 so that upon gripping of the shaft 15 and upon reversal of the direction of rotation of the drive motor 50 in the direction of arrow "D", the threaded stub 19 readily disengages from the threaded end 16 of the shaft 15.

The guide member 46 of the gripping member 40 is shown as a guide roller 47 contacting the drive shaft 15 and mounted for rotation about an axis 48 transverse to the longitudinal axis of the drive shaft 15. The guide roller 47 is mounted to a carrier 49 which in turn is mounted by an axle 51 therethrough to tracks 52 which incline towards the axis of the drive shaft 15. Axle pin 51 carries rollers 53 which engage with plate 54 above the tracks 52. Thus rotation of the drive shaft 15 in the direction of arrow "D" tends to move the guide roller 47 in the direction such that the axle 51 moves in the tracks 52 towards axis of the drive shaft 15 as do rollers 53 moving along the undersurface of plate 54 thereby causing the guide roller 47 to tightly engage with the drive shaft 15 and grip the same.

This gripping of the shaft 15 will be seen to make extension of the shaft length a simple and easy operation for one person.

The allowance by the roller 47 for longitudinal movement of the shaft 15, even when tightly engaged as a result of drive reversal in the direction of arrow "D", enables the threaded stub 19 at the drive motor 50 to be unscrewed from the threaded end 16 with the associated short longitudinal movment occurring without stripping the thread from the stub 19 or shaft bore or overloading the motor 50.

Figure 5:
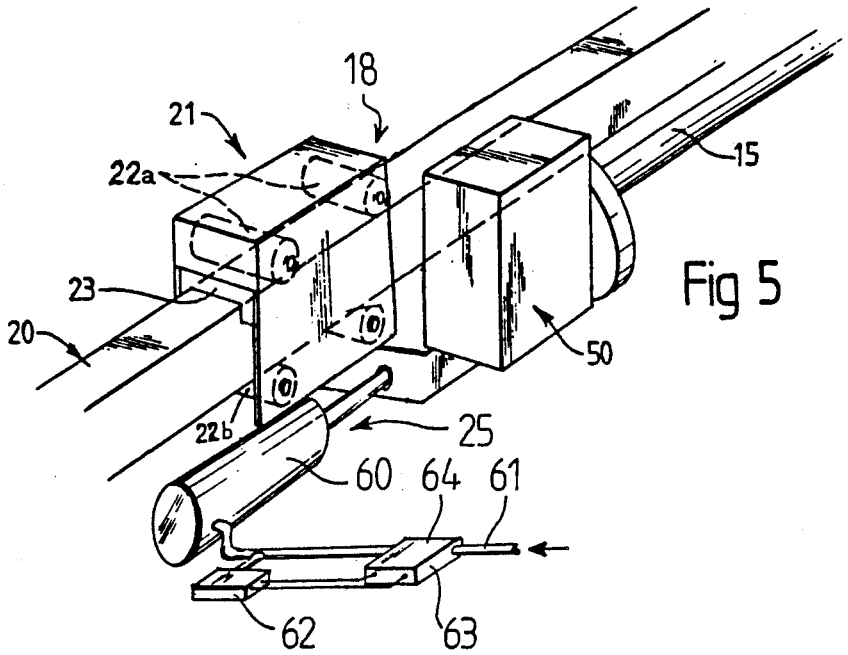
FIG. 5 is an alternative carriage drive arrangement.

In FIG. 5 there is shown schematically an alternative drive means 25 for the carriage 18 comprising a hydraulic ram 60 and hydraulic supply line 61. A hydraulic fluid pressure sensor 62 senses fluid pressure increases, e.g. which results from the boring tool encountering harder ground. The control means 63 includes a control valve 64 which is responsive to the sensor 62 to control hydraulic fluid pressure supplied to the ram 60 to stop or slow advancing movement of the carriage 18 and hence of the drive shaft 15.

The preferred apparatus illustrated will be seen to alleviate or overcome all of the disadvantages of the prior apparatus as discussed above.

It is to be understood that various alterations, modifications and/or additions may be made to the features of the possible and preferred embodiment(s) of the invention as herein described without departing from the scope of the invention as defined in the appended claims.

We claim:

1. An earth boring apparatus for driving a boring tool, the tool having a head for penetrating the earth and a longitudinally extending rotary drive shaft for advancing the head, the apparatus including a support frame, a carriage movably mounted to the support frame for movement therealong, said carriage being movable to advance the drive shaft and head relative to said frame to penetrate the earth and for retracting movement relative to the frame to enable a drive shaft extension to be fitted between the carriage and the drive shaft, a drive shaft engaging member associated with said frame and selectively operative to engage the drive shaft to inhibit rotation thereof thereby enabling the carriage to be retracted and the drive shaft extension to be fitted between the carriage and the drive shaft, said drive shaft engaging member including a roller for contacting the drive shaft, said roller having an axis of rotation extending generally transverse to the longitudinal direction of the drive shaft so that when said roller is engaged with said drive shaft rotational movement of the drive shaft is inhibited while longitudinal movement thereof is permitted.

2. An earth boring apparatus as claimed in claim 1, wherein said roller is mounted to said frame so that it engages, locates and guides said drive shaft and allows said drive shaft to rotate in one direction and grips and tightly engages said drive shaft upon rotation of the drive shaft in a direction opposite to said one direction.

3. An earth boring apparatus as claimed in claim 2 wherein the roller is mounted so as to be movable relative to a portion of the support frame, said roller mount including a camming arrangement which causes said roller to tightly engage the drive shaft upon rotational movement of the shaft in said opposite direction.

4. An earth boring apparatus as claimed in claim 3 wherein the roller is mounted to a carrier which in turn is mounted by an axle to a track which inclines towards the drive shaft, rotation of the drive shaft in said opposite direction tending to move the roller in said opposite direction such that the axle moves in the track towards the drive shaft thereby causing the roller to tightly engage and grip said drive shaft.

5. An earth boring apparatus as claimed in claim 1 wherein said roller is operative to frictionally engage said drive shaft to inhibit rotation thereof.

6. An earth boring apparatus as claimed in claim 1 wherein said roller is operative to engage said drive shaft to allow rotation thereof in one rotational direction and to inhibit rotation thereof in direction opposite to said one rotational direction.

7. An earth boring apparatus as claimed in claim 6 and further including drive means for rotating the drive shaft in said one rotational direction to effect boring of the earth, said drive means including a reversible drive source and a threaded portion for engaging a complementary threaded end portion of the drive shaft, said engaging portion being operative when the reversible drive source is actuated to rotate in the opposite direction to restrain the drive shaft against rotation in the opposite rotational direction thereby effecting disengagement of the threaded portion of the drive means from the threaded end portion of the drive shaft.

8. An earth boring apparatus as claimed in claim 7 wherein the shaft means further includes a thrust bearing between the reversible drive source and said threaded end portion so that upon reversal of the direction of rotation of the drive shaft to rotate it in the opposite direction and upon restraint of the drive shaft against rotation, the threaded portion of the drive means disengages from said threaded end portion.

9. An earth boring apparatus for driving a boring tool, the tool having a head for penetrating the earth and a longitudinally extending rotary drive shaft for advancing the head, the apparatus including a support frame, a carriage movably mounted to the support frame, said carriage supporting a drive shaft and a head attached thereto, said carriage being mounted for advancing and retracting movement relative to the frame so as to enable a drive shaft to be driven and modified in length; advancing drive means for advancing the carriage and drive shaft, said advancing drive means including reaction means for sensing variations in earth resistance to penetration by the head, control means responsive to the penetration resistance sensed by said reaction means for controlling the operation of said advancing drive means to lessen the advancing force in response to increases in penetration resistance, said advancing drive means being mounted on the carriage and including a rotary drive bar for advancing the carriage, said reaction means including a mounting for said advancing drive means which is capable of limited pivoting movement relative to the carriage about an axis collinear with the rotational axis of the rotary drive bar in response to impeded movement of the carriage and continued operation of the advancing drive means, including rotary movement of the drive bar, said control means including a disabling switch operable in response to the limited pivoting movement of said reaction means to disable the advancing drive means.

10. An earth boring apparatus for horizontally driving a boring tool, the tool having a head for penetrating the earth and a longitudinally and horizontally extending rotary drive shaft for advancing the head, said apparatus including a support frame, a carriage mounted to the support frame for advancing movement of the drive shaft and head to penetrate the earth, the carriage furthermore being mounted for retracing movement relative to the frame so as to enable a drive shaft extension to be fitted between the carriage and the drive shaft operatively connected to the head, said frame including a base portion for engaging the ground and a horizontal and longitudinally extending carriage track located above the base portion, said carriage being operatively engaged with the carriage track, drive means for advancing and retracting said carriage along the carriage track, said carriage track having at least one horizontally extending support surface for movably supporting said carriage and at least one sidewall, said drive means being mounted to extend along said carriage track and spaced away from said at least one horizontal support surface on said at least one sidewall so that said drive means is protected from debris, a drive wheel mounted for rotating movement about an upright axis and horizontally and laterally adjacent the carriage track relative to the longitudinal direction thereof and operative to cooperate with the carriage track to drive the carriage therealong as the drive wheel is rotated.

11. An earth boring apparatus as claimed in claim 10 wherein said carriage includes a scraping tool to scrape debris from said at least one horizontal surface as said carriage moves therealong.

12. An earth boring apparatus as claimed in claim 11 wherein the drive chain is fixed to the frame at each end, the chain extending from a first end along the sidewall of the track, around an idler wheel on the carriage, thence around a drive sprocket, thence around a further idler wheel and along the track to the opposite end.

13. An earth boring apparatus as claimed in claim 10 wherein said carriage includes a track follower arranged to follow the track with a rolling engagement, the track follower closely engaging the track to limit rocking movement of the carriage relative to the track.

14. An earth boring apparatus as claimed in claim 13 wherein the track follower includes upper rollers in rolling engagement with an upper surface of the track and lower rollers in rolling engagement with a lower surface of the track, the upper and lower rollers restraining the carriage against movement of said carriage relative to said track except linear movement in the longitudinal direction along said track.

* * * * *